United States Patent [19]

Stienstra

[11] Patent Number: 4,815,378

[45] Date of Patent: Mar. 28, 1989

[54] METHOD AND DEVICE FOR PRINTING IMAGES ON HALVES OF BOTH SIDES OF SHEETS

[75] Inventor: Jan B. Stienstra, Venlo, Netherlands

[73] Assignee: Oce-Nederland B.V., Venlo, Netherlands

[21] Appl. No.: 919,230

[22] Filed: Oct. 15, 1986

[30] Foreign Application Priority Data

Nov. 4, 1985 [NL] Netherlands ..... 8503006

[51] Int. Cl.[4] ..... B41F 5/02

[52] U.S. Cl. ..... 101/230; 101/231; 101/426; 271/3.1; 271/186; 271/291; 355/145 H; 355/24

[58] Field of Search ..... 101/426, 230–231; 271/288, 289, 291, 3–3.1, 186; 355/145 H, 35 H, 24, 26

[56] References Cited

U.S. PATENT DOCUMENTS

| | | | |
|---|---|---|---|
| 4,272,181 | 6/1981 | Treseder | 355/145 H |
| 4,334,765 | 6/1982 | Clark | 355/145 H |
| 4,456,237 | 6/1984 | Buddendeck | 271/291 |
| 4,508,447 | 4/1985 | Doery | 355/145 H |
| 4,579,325 | 4/1986 | Pinckney et al. | 271/3.1 |
| 4,669,717 | 6/1987 | Yamashita et al. | 271/186 |
| 4,711,550 | 12/1987 | Sumida et al. | 355/35 H |

FOREIGN PATENT DOCUMENTS 0041602 12/1981 European Pat. Off. .

OTHER PUBLICATIONS

Japanese Patent Abstract, vol. 9, No. 151, p. 367, (1374), 6–26–85 of 60–29736.

Japanese Patent Abstract, vol. 7, No. 23, p. 171, (1168), 1–29–83 of 57–176029.

*Primary Examiner*—Eugene M. Eickholt

*Attorney, Agent, or Firm*—Reed Smith Shaw & McClay

[57] ABSTRACT

The present invention provides a method and a device for printing images on halves of both sides of a group of receiving sheets by passing each sheet seriatim four times directly in succession through a printing station thereby printing the four halves of the sheet. The sheets thus printed are together folded double to form a book in which the sequence of the images corresponds to the sequence of the original images.

1 Claim, 2 Drawing Sheets

METHOD AND DEVICE FOR PRINTING IMAGES ON HALVES OF BOTH SIDES OF SHEETS

FIELD OF THE INVENTION

The present invention relates to a method and device for printing images on halves of both sides of receiving sheet, such that when the printed sheets together are folded double, they form a book in which the sequence of the images corresponds to the sequence of the original images.

BACKGROUND OF THE INVENTION

A method of printing images on halves of both sides of sheets is described in U.S. Pat. No. 4,334,765 and its corresponding European Patent Application No. 41,602. To make a book of prints from a group of numbered originals by this method, one half of the first side of a number of sheets are printed with half the odd-numbered originals. The other half of the odd-numbered originals are printed on one half of the second side of the number of sheets. Half the even-numbered originals are then printed on that half of the first side of the number of sheets which are still unoccupied by an image and the other half of the even-numbered originals are printed on that half of the second side of the sheets which are still unoccupied by any image.

The disadvantage of this method is that the sheets which together are required to form the book must be deposited on a stack after an image has been printed on each sheet and the sheets thereafter have to be individually withdrawn from the stack to print the next image thereon. This readily leads to errors in printing images in the correct sequence on the sheets, for example, because sheets that have been joined together continue to stick to one another and pass through the apparatus together. An error of this kind often cannot be corrected and usually causes the entire book production to be unusable.

The problems involved with refeeding copy sheets through a printing station for double-sided copying are different from the problems involved with refeeding original in single-sided copying. U.S. Pat. No. 4,508,447, Japanese Abstract No. 57-176029 and Japanese Abstract No. 60-29736 all relate to handling originals in single sided copying. They do not address the problems of refeeding copy sheets in double-sided copying.

U.S. Pat. No. 4,188,881 describes a method of printing images on halves of only one side of copy sheets and requires that the copy sheets must be cut into two packs which are assembled to form a set of single-sided copies in page order. U.S. Pat. No. 4,194,832 requires zigzag folding, cutting and trimming to form the finished book. Neither of these references describes copying on both halves of both sides of the sheet so that the resulting book can be formed by folding in half.

Therefore, it would be desirable to provide a method and device for printing images on halves of both sides of sheets, such that when the printed sheets together are folded double, they form a book without the disadvantages referred to above.

SUMMARY OF THE INVENTION

Generally, the present invention relates to a method and device for printing images on both halves of both sides of a plurality of receiving sheets fed through a printing station such that when the printed sheets together are folded double, they form a book in which the sequence of the plurality of images therein corresponds to the sequence of the plurality of original images presented for printing.

In the method according to the present invention, each sheet is passed directly in succession through the printing station four times thereby printing the four halves of the sheet. After each of the first three passes through the printing station, the sheet is turned over for the printing of the next image on the other side of the sheet than that on which the previous image was printed. After the last pass, the sheet is collected in the correct orientation to form the book.

This method is implemented by a device comprising a printing station, a conveyor path through the printing station, a sheet turn-over path and a sheet discharge path, both following the conveyor path, and a sheet deflector which in a first position guides a sheet from the printing station into the turn-over path and, in a second position, guides the sheet from the printing station into the discharge path. A first control means is provided which holds the sheet deflector in a first position during the first three consecutive passes of a sheet and in a second position during the following fourth pass. Also, a time element is provided which so controls the time it takes a sheet to pass through the printing station that on the first and fourth passes, an image is printed on a half of the sheet which, when considered in the direction of passage, is other than the half of the sheet printed in the second and third passes. Preferably, the image is printed on the leading half of the sheet during the first and fourth passes and the trailing half of the sheet during the second and third passes.

As a result of this method, each of a number of sheets which when together folded double form a book, can be completely processed before the processing of a subsequent sheet starts. If the sheets are processed in sequence from the outermost sheet to the innermost sheet of the book, then an additional effect is that the relevant originals can be processed in ascending sequence from the lowest number or in descending sequence from the highest number.

The present invention is particularly attractive for printing originals present in electronic form, but it can also be used for printing originals in sheet form. In the latter case, a preferred embodiment is provided with a document feeder for individually feeding originals in sheet form from a stack to a scanning station and a document deposit device. The feeder comprises two conveyor means which can each feed an original from a different side of the stack. The document deposit device comprises two deposit plates. The originals which are fed from one side of the stack are deposited on the one deposit plate and the originals fed from the other side of the stack are deposited in the reverse orientation on the other deposit plate.

With this embodiment, it is possible to perform a copying cycle in which successively two originals from one side of the stack and two originals from the other side of the stack are automatically scanned and copied to make a copy set from the original set which consists of a number of originals which is a multiple of four. The copy set is foldable together to form the book referred to above.

To make such a book starting from an arbitrary number of originals (other than a multiple of four), this preferred embodiment further comprises an adjustment means which can be set to the number of originals that the stack contains and a control means which generates a first count signal corresponding to the next higher figure with respect to the number of originals in the set, the figure being a multiple of four, so as to perform the copying cycle the appropriate number of times corresponding to the figure. The control means also generates a second count signal corresponding to the difference between the figure and the number of originals in the set. Other control means automatically keep one of the conveyor means inoperative from the start of the first cycle for a number of times which corresponds to the difference between the figure and the number of originals in the set, the copying cycle sequence being otherwise the same.

Other advantages of the invention will become apparent from the detailed description and the accompanying drawings of presently preferred embodiments of the best mode of carrying out the invention.

DESCRIPTION OF THE PREFERRED EMBODIMENT

Generally, FIGS. 1A to 1D show a holder 10 for a stack of receiving sheets. A take-off roller 6 can separate these sheets from the stack individually and feed them to a feed path 3, along which the sheet is fed to a printing station 4.

Figure 1A:
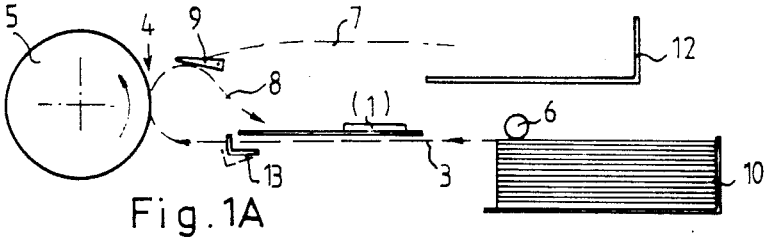
FIGS. 1A to 1D diagrammatically illustrate the copying portion of a device according to the present invention showing different stages in the printing of a receiving sheet according to the method of the invention.
Figure 1B:
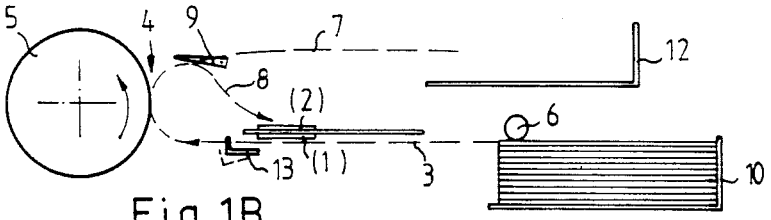
Figure 1C:
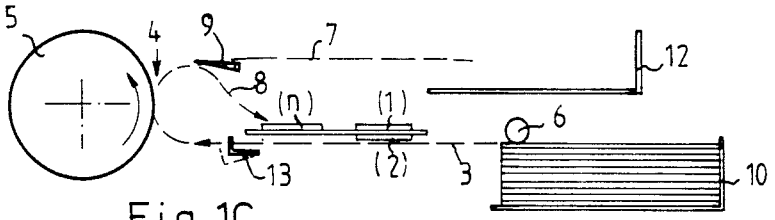
Figure 1D:
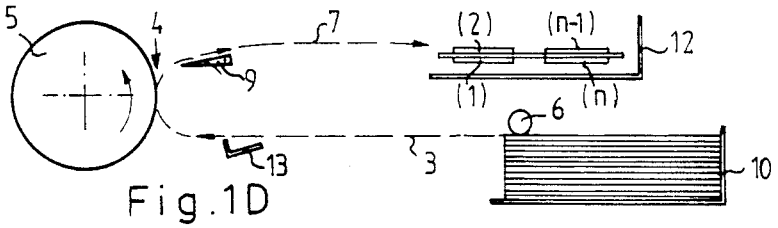

At printing station 4, the receiving sheet comes into contact with a continuously moving image support 5. Images may have been applied to image support 5 at regular intervals by any number of known means (not shown) and can be transferred onto the receiving sheet at printing station 4. After printing station 4, feed path 3 is followed by sheet discharge path 7 and a sheet turn-over path 8. A sheet deflector 9 is provided at the junction of sheet discharge path 7 and sheet turn-over path 8 and can occupy two positions: a return position as shown in FIGS. 1A to 1C, in which a sheet fed through path 3 is fed into turn-over path 8; and a discharge position as shown in FIG. 1D, in which a sheet fed through path 3 is fed to discharge path 7.

Dicharge path 7 leads into a collector tray 12 wherein the completely printed sheets can be deposited on one another. Turn-over path 8 leads back to feed path 3. Disposed in feed path 3 prior to printing station 4 is an actuatable retaining means 13 which in an operative state retains a sheet in feed path 3 that has come directly from holder 10 or which has come via turn-over path 8. When rendered inoperative, retaining means 13 releases the retained sheet for conveyance to printing station 4. A known control system (not shown) of the printing device is connected to retaining means 13 to release a retained sheet at a predetermined interval so that it can be fed to printing station 4.

A book as described in the Summary of the Invention can be formed as follows by using the printing device shown in FIGS. 1A to 1D. Holder 10 is filled with receiving sheets of a size such that two images can be applied next to one another in the direction of passage of the sheets.

When the total number of images required in a book is a multiple of four, the relevant images are applied to continuously moving image support 5 in a sequence in which first the two lowest numbered images and then the two highest numbered images reach printing station 4 and then, of the remaining images, in each case first the two lowest numbered images and then the two highest numbered images, until all the images have been applied.

If the total number of images is not a multiple of four, then the next higher multiple of four is used and the image locations for the missing highest numbered images are left blank on image support 5.

When the first receiving sheet is in readiness at retaining means 13, the printing device control system release the receiving sheet for further conveyance at a time such that the first lowest numbered image (1) is printed on the leading half of that receiving sheet in printing station 4. During the printing of the first image (1), sheet deflector 9 is in a position such that the receiving sheet is fed to the sheet turn-over path 8, so that it returns to feed path 3 in a turned-over position and is retained in feed path 3 by retaining means 13 which has been reactuated in the meantime. This is the condition shown in FIG. 1A.

The retained receiving sheet is then released by the control system for further conveyance, at a time such that the next image (2) having the next lowest number but one is printed on the trailing half of that receiving sheet when it is in printing station 4. The sheet is returned to feed path 3 by sheet turn-over path 8 and this is the condition shown in FIG. 1B.

To print the next higher numbered image (n), the latter operation including printing on the trailing half of the receiving sheet is repeated resulting in the conditon shown in FIG. 1C.

Then, a control signal is generated causing sheet deflector 9 to be put into the discharge position. The receiving sheet in readiness at retaining means 13 is released for further conveyance at a time such that the next highest numbered image but one (n−1) is printed in printing station 4 on the leading half of the receiving sheet.

The receiving sheet, which now has four images on it, is deposited via discharge path 7 into tray 12 as shown in FIG. 1D with the first printed image (1) facing downwards.

This cycle, in which four images can be formed in direct succession on a receiving sheet is repeated for each remaining series of four images. The sheets printed in this manner are deposited on the previously printed sheets forming a stack. The sheets in the stack are then together folded double to form a book. Prior to folding, the sheets can be joined together by stapling the set at the fold line.

Figure 2:
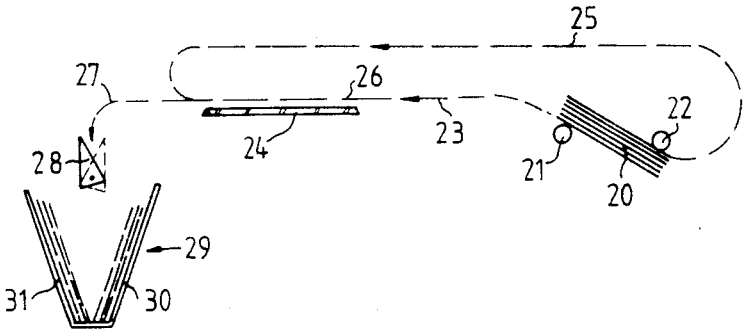
FIG. 2 diagrammatically illustrates the feeding portion of a device by which it is possible to make a set of copies automatically by the method of the present invention from a set of originals printed on one side.

FIG. 2 diagrammatically illustrates a portion of a device according to the present invention by which a set of copies can be made automatically from a set of original sheets printed on one side.

The device has a magazine 20 in which a stack of originals can be placed. The magazine is provided with a sheet take-off roller 21 for individually taking sheets from the bottom of the stack and a sheet take-off roller 22 for individually taking sheets from the top of the stack. A sheet taken off by roller 21 can be fed via a path 23 to an exposure platen 24 of the device and a sheet taken off by roller 22 can be fed via a path 25 to exposure platen 24.

A common path 26 extending along exposure platen 24 is followed by discharge path 27 along which an exposed original can be fed via a sheet deflector 28 to a receiving tray 29. Tray 29 is formed by two deposit plates 30 and 31 extending obliquely upwards in opposite directions and interconnected by their bottom edge.

Sheet deflector 28 in the starting position indicated by the solid lines guides a sheet fed through path 27 in the direction of deposit plate 30 and in the position indicated by the broken lines in the direction of deposit plate 31. The operation of this device for feeding a set of originals in the sequence required for automatically performing the copying method described above is as follows.

A set of originals consisting of a multiple of four, or made up to such multiple by blank sheets, is placed in magazine 20 with the image sides facing downwards. Roller 21 is then actuated to take the bottom original from magazine 20. This original is fed via path 23 to exposure platen 24 to form an image (1) on image support 5 which is shown in FIGS. 1A to 1D. The original is then fed through discharge path 27 to deposit plate 30 by sheet deflector 28 which is in the starting position. The original is deposited with the image side facing downwards. This cycle is repeated with the next bottom original of the originals still in magazine 20 to form an image (2).

Roller 22 is then actuated to take off the top original from magazine 20. This original is fed via path 25 to exposure platen 24 to form a subsequent image (n) on image support 5. Then, the original is fed through discharge path 27 and sheet deflector 28, which has in the meantime been set to the broken line position so that the original is deposited on deposit plate 31 with the image side facing upwards. This cycle too is repeated with the next top original of the originals remaining in magazine 20 to form an image (n−1).

The four above-described cycles are repeated for the next four originals until magazine 20 is empty. A copy set is made in the manner described above with reference to FIGS. 1A to 1D from the images formed on image support 5. The originals deposited on deposit plates 30 and 31 are pressed together and removed as a whole from tray 29.

Figure 3:
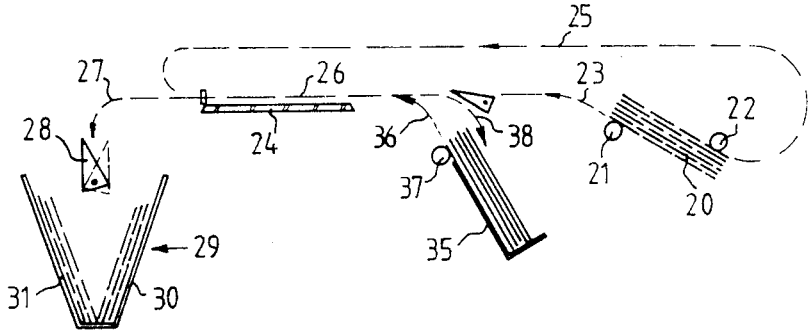
FIG. 3 diagrammatically illustrates the feeding portion of a device by which a number of copy sets can be made automatically from a set of originals printed on one side.

Another embodiment for feeding originals is shown in FIG. 3. It is similar to the embodiment shown in FIG. 2 except that a tray 35 is added which is provided with a feed path 38 along which exposed originals can be fed into the tray and a take-off roller 37 which returns the bottom oroginal from the tray back to exposure plate 24 via feed path 36. To make one copy set, the embodiment shown in FIG. 3 operates in the same way as the embodiment described and shown in FIG. 2.

To make more copy sets from one set of originals, the originals, after being exposed once, are fed into tray 35 and then individually returned to platen 24 by take-off roller 37. This cycle is repeated until the last copy set is made. During the making of the last copy set, the originals are fed to receiving tray 29 where they are deposited in the manner described above with reference to FIG. 2. If a fault is signaled during the recycling of originals to and from tray 35, only the copy set in progress can be defective; the previously made and deposited copy sets are correct. The effects of an error in the stacking and withdrawal of originals are in this case not as serious as the disadvantage of stacking partially printed sheets as referred to in the Background Section above.

Instead of adding blank sheets to the originals placed in magazine 20 to enable a multiple of four originals always to be used, the control system of the device can be so constructed that instead of feeding a blank sheet, take-off roller 22 or take-off roller 37, respectively, is kept inoperative at the relevant times, the cycle sequence otherwise being the same.

While presently preferred embodiments of the invention have been shown and described in particularity, the invention may be otherwise embodied within the scope of the appended claims.

What is claimed is:

1. A device for printing images on halves of both sides of a receiving sheet, said device comprising:

(a) a printing station;

(b) a sheet conveyor path through the printing station;

(c) a sheet turn-over path following the conveyor path for re-feeding a sheet to the printing station;

(d) a sheet discharge path following said conveyor path;

(e) sheet conveyor means for conveying sheets in said paths;

(f) a sheet deflector having a first position to guide a sheet from said sheet conveyor path into said turn-over path and a second position to guide said sheet from said sheet conveyor path into said discharge path;

(g) first control means for holding said sheet deflector in said first position during three consecutive passes of a sheet through the sheet conveyor path and in a second position during a fourth pass of the sheet through said sheet conveyor path; and (h) second control means for printing an image on one half of the sheet in said first and fourth passes of said sheet and for printing an image on the other half of the sheet in the second and third passes of said sheet.

* * * * *